US009682328B2

(12) United States Patent
Yang et al.

(10) Patent No.: US 9,682,328 B2
(45) Date of Patent: Jun. 20, 2017

(54) TOY VEHICLE TRACK

(71) Applicant: Honor Metro Limited, Tortola (VG)

(72) Inventors: Nai Yang, Temple City, CA (US); Matthew Cherowitzo, Los Angeles, CA (US)

(73) Assignee: Honor Metro Limited (VG)

( * ) Notice: Subject to any disclaimer, the term of this patent is extended or adjusted under 35 U.S.C. 154(b) by 345 days.

(21) Appl. No.: 14/483,857

(22) Filed: Sep. 11, 2014

(65) Prior Publication Data

US 2016/0074761 A1 Mar. 17, 2016

(51) Int. Cl.
*A63H 18/00* (2006.01)
*A63H 18/02* (2006.01)

(52) U.S. Cl.
CPC ..... *A63H 18/02* (2013.01)

(58) Field of Classification Search
CPC ..... A63H 18/00; A63H 18/02; A63H 18/021; A63H 18/028
See application file for complete search history.

(56) References Cited

U.S. PATENT DOCUMENTS

| | | | | |
|---|---|---|---|---|
| 67,889 | A | 8/1867 | Lane | |
| 3,643,865 | A | 2/1972 | Mutz et al. | |
| 3,680,927 | A | 8/1972 | Neureuther | |
| 3,729,134 | A | 4/1973 | Cook et al. | |
| 3,734,404 | A | 5/1973 | Baynes et al. | |
| 4,449,665 | A | 5/1984 | Gladfarb et al. | |
| 4,544,094 | A | 10/1985 | Scholey | |
| 4,684,017 | A | 8/1987 | Watanabe et al. | |
| 5,049,104 | A * | 9/1991 | Olsen | A63H 33/042 403/156 |
| 5,160,091 | A | 11/1992 | Hesse | |
| 5,628,670 | A | 5/1997 | Hill | |
| 5,645,463 | A * | 7/1997 | Olsen | A63H 33/042 446/104 |
| 5,991,975 | A * | 11/1999 | Baer | E05D 7/009 16/250 |
| 6,299,072 | B1 | 10/2001 | Burns | |

(Continued)

FOREIGN PATENT DOCUMENTS

| | | |
|---|---|---|
| CN | 201088854 | 7/2008 |
| GB | 664998 | 1/1952 |
| WO | 0021629 | 4/2000 |

OTHER PUBLICATIONS

Corresponding Australian Office Action dated Nov. 9, 2016.

*Primary Examiner* — Jason C Smith
(74) *Attorney, Agent, or Firm* — Belles Katz LLC

(57) ABSTRACT

A track for a toy vehicle and a track section that is used to form the track. In one embodiment, the track section includes a first edge, a second edge, and an upper surface extending therebetween; a first connector extending from the first edge, the first connector comprising an inner surface that defines a receiving cavity and an outer surface comprising a plurality of detents; a second connector extending from the second edge, the second connector being spaced apart from a portion of the second edge by a gap; and first and second slots extending from the second edge towards the first edge to form a hinge section of the track section between the first and second slots, the hinge section comprising the portion of the second edge of the track section.

20 Claims, 10 Drawing Sheets

(56) References Cited

U.S. PATENT DOCUMENTS

| | | | | |
|---|---|---|---|---|
| 6,398,120 | B1 | 6/2002 | Klein | |
| 6,427,926 | B1 | 8/2002 | Lai | |
| 6,447,358 | B1 * | 9/2002 | Mikkelsen | A63H 33/042 16/260 |
| 6,508,689 | B1 * | 1/2003 | Mikkelsen | A63H 33/042 446/108 |
| 6,834,416 | B2 | 12/2004 | Wang et al. | |
| 7,124,471 | B2 | 10/2006 | Koessler | |
| 7,369,672 | B2 | 5/2008 | Kirschhorn | |
| 8,024,839 | B2 * | 9/2011 | Lewis, II | E05D 7/1072 16/266 |
| 8,156,613 | B2 * | 4/2012 | Smith | E05D 11/06 16/374 |
| 2002/0066795 | A1 * | 6/2002 | Kong | A63H 18/00 238/10 F |
| 2012/0257922 | A1 * | 10/2012 | Lin | E05D 3/02 403/161 |
| 2015/0060560 | A1 * | 3/2015 | Yu | A63H 18/028 238/10 A |
| 2016/0074761 | A1 * | 3/2016 | Yang | A63H 18/02 238/10 F |

* cited by examiner

TOY VEHICLE TRACK

FIELD OF THE INVENTION

The present invention relates generally to a track for a toy vehicle and a track section that is used to form the track.

BACKGROUND OF THE INVENTION

Many children find enjoyment and entertainment with the use of toy vehicles and tracks for such vehicles. Many of the current tracks have solid pieces that can be put together to form a track having a single configuration. There are other tracks in existence that enable the user to have some flexibility in the arrangement of the track pieces. Still other tracks exist that utilize flexible track pieces that can be bent to a certain degree to provide more flexibility in the track configuration created using the track pieces. However, tracks of this type are typically complicated to set up, which can result in frustration to a child attempting to build the track herself. Thus, a need exists for a toy vehicle track and track sections for use in building the toy vehicle track that are simple to manufacture and easy to put together to build the track while still enabling adequate flexibility in the end-result track configuration.

BRIEF SUMMARY OF THE INVENTION

Exemplary embodiments according to the present disclosure are directed to a track for a toy vehicle and to a track section of a track for a toy vehicle. Each of the track sections comprises first and second edges and an upper surface extending therebetween. Furthermore, the track sections comprise a first connector extending from the first edge and a second connector extending from the second edge. The first connector of one of the track sections receives the second connector of another one of the track sections to detachably couple two of the track sections together. Furthermore, when coupled together the first and second track sections are movable relative to one another to adjust the inclination of the upper surfaces so that the track. created using the track sections is modular and adjustable.

In one aspect, the invention can be a track for a toy vehicle comprising: a first track section and a second track section each having a first edge, a second edge, and an upper surface for supporting a toy vehicle extending between the first and second edges; a first connector extending from the first edge of the first track section, the first connector comprising an inner surface that defines a receiving cavity and an outer surface comprising a plurality of detents; a second connector extending from the second edge of the second track section, the second connector being spaced apart from a first portion of the second edge of the second track section by a gap; and wherein the first and second track sections are detachably coupled together by positioning the second connector of the second track section within the receiving cavity of the first connector of the first track section, the first connector of the first track section extending into the gap between the second connector of the second track section and the first portion of the second edge of the second track section so that the first portion of the second edge of the second track section positioned within a first one of the plurality of detents of the outer surface of the first connector of the first track section.

In another aspect, the invention can be a track for a toy vehicle comprising: a first track section and a second track section that are detachably coupled together to form a track for a toy vehicle, each of the first and second track sections having a first edge, a second edge, and an upper surface; a first connector extending from the first edge of the first track section, the first connector comprising an inner surface that defines a receiving cavity and an outer surface comprising a plurality of detents; a second connector coupled to the second track section and spaced apart from a portion of the second edge of the second track section by a gap; the second connector of the second track section positioned within the receiving cavity of the first connector of the first track section, the first and second track sections rotatable relative to one another between: (1) a first position in which the portion of the second edge of the second track section is positioned within a first one of the plurality of detents of the outer surface of the first connector of the first track section and a first angle is formed between the upper surfaces of the first and second track sections; and (2) a second position in which the portion of the second edge of the second track section is positioned within a second one of the plurality of detents of the outer surface of the first connector of the first track section and a second angle is formed between the upper surfaces of the first and second track sections, the first and second angles being different.

In yet another embodiment, the invention can be a track for a toy vehicle comprising: a first track section and a second track section that are detachably coupled together to form a track for a toy vehicle, each of the first and second track sections having a first edge, a second edge, and an upper surface; a first connector extending from the first edge of the first track section, the first connector comprising an inner surface that defines a receiving cavity; a second connector extending from the second edge of the second track section, the second connector being spaced apart from a first portion of the second edge of the second track section by a gap; the second connector of the second track section positioned within the receiving cavity of the first connector of the first track section, the first and second track sections movable relative to one another between: (1) a first position in which a first angle is formed between the upper surfaces of the first and second track sections; and (2) a second position in which a second angle is formed between the upper surfaces of the first and second track sections, the first and second angles being different; and wherein the first connector of the first track section extends into the gap in both the first and second positions.

In still another aspect, the invention can be a track section for a toy vehicle track comprising: a first edge, a second edge, and an upper surface for supporting a toy vehicle extending between the first and second edges, the track section having a first longitudinal axis extending from the first edge to the second edge; a first connector extending from the first edge along a second longitudinal axis, the first connector comprising an inner surface that defines a receiving cavity and an outer surface comprising a plurality of detents; a second connector extending from the second edge along a third longitudinal axis, the second connector being spaced apart from a portion of the second edge by a gap; and first and second slots extending from the second edge towards the first edge to form a hinge section of the track section between the first and second slots, the hinge section comprising the portion of the second edge of the track section.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

Figure 1:
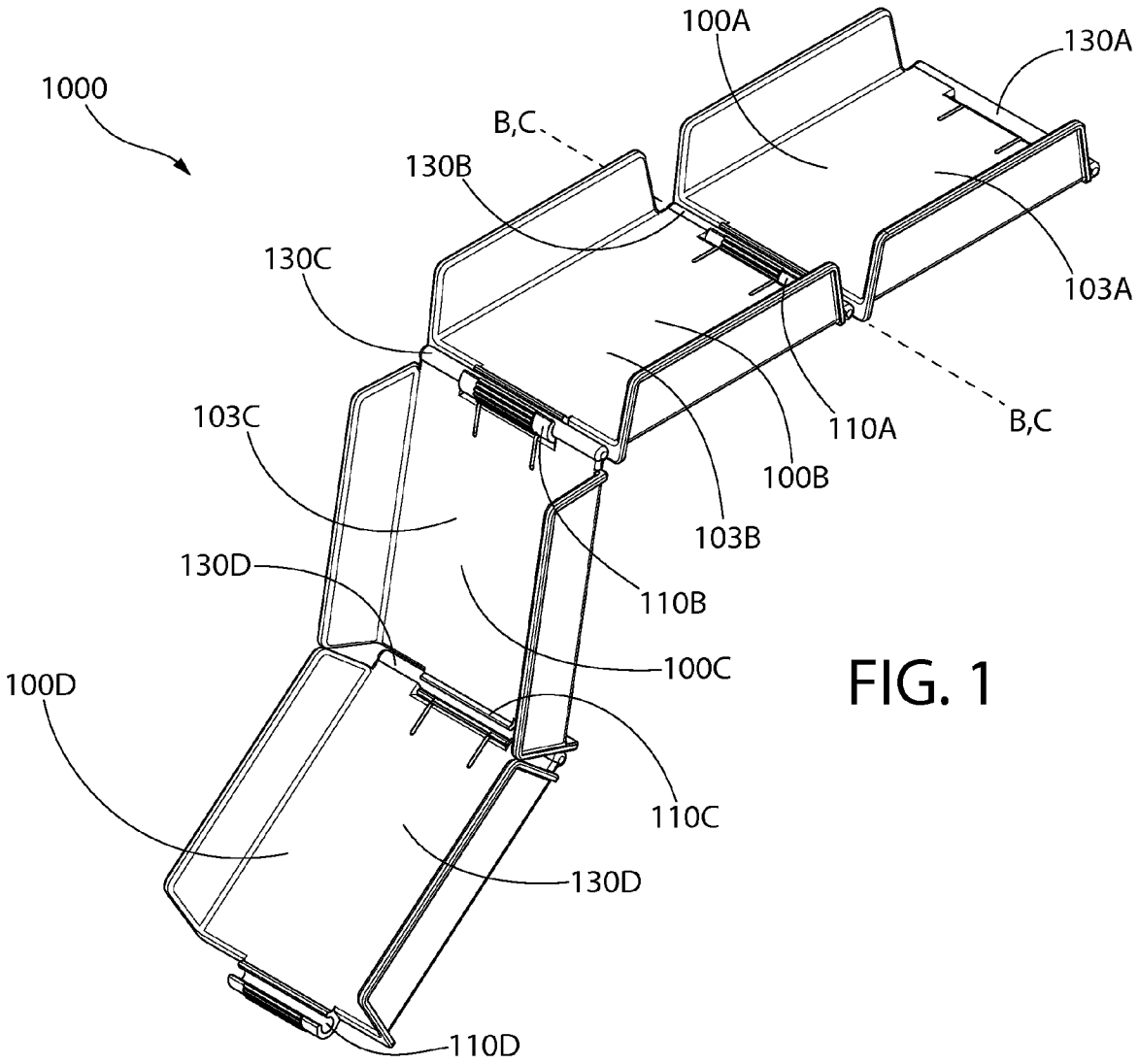
FIG. 1 is a top perspective view of a track for a toy vehicle in accordance with an embodiment of the present invention.

The following description of the preferred embodiment(s) is merely exemplary in nature and is in no way intended to limit the invention, its application, or uses.

The description of illustrative embodiments according to principles of the present invention is intended to be read in connection with the accompanying, drawings, which are to be considered part of the entire written description. In the description of embodiments of the invention disclosed herein, reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto. Furthermore, it should be appreciated that the use of the terms "first," "second," "third," "fourth," and similar is merely intended to distinguish among features or components when several features or components are referred to by the same term. The use of these terms in the detailed description and in the claims is not intended to be limiting of the scope of the present invention.

Figure 2:
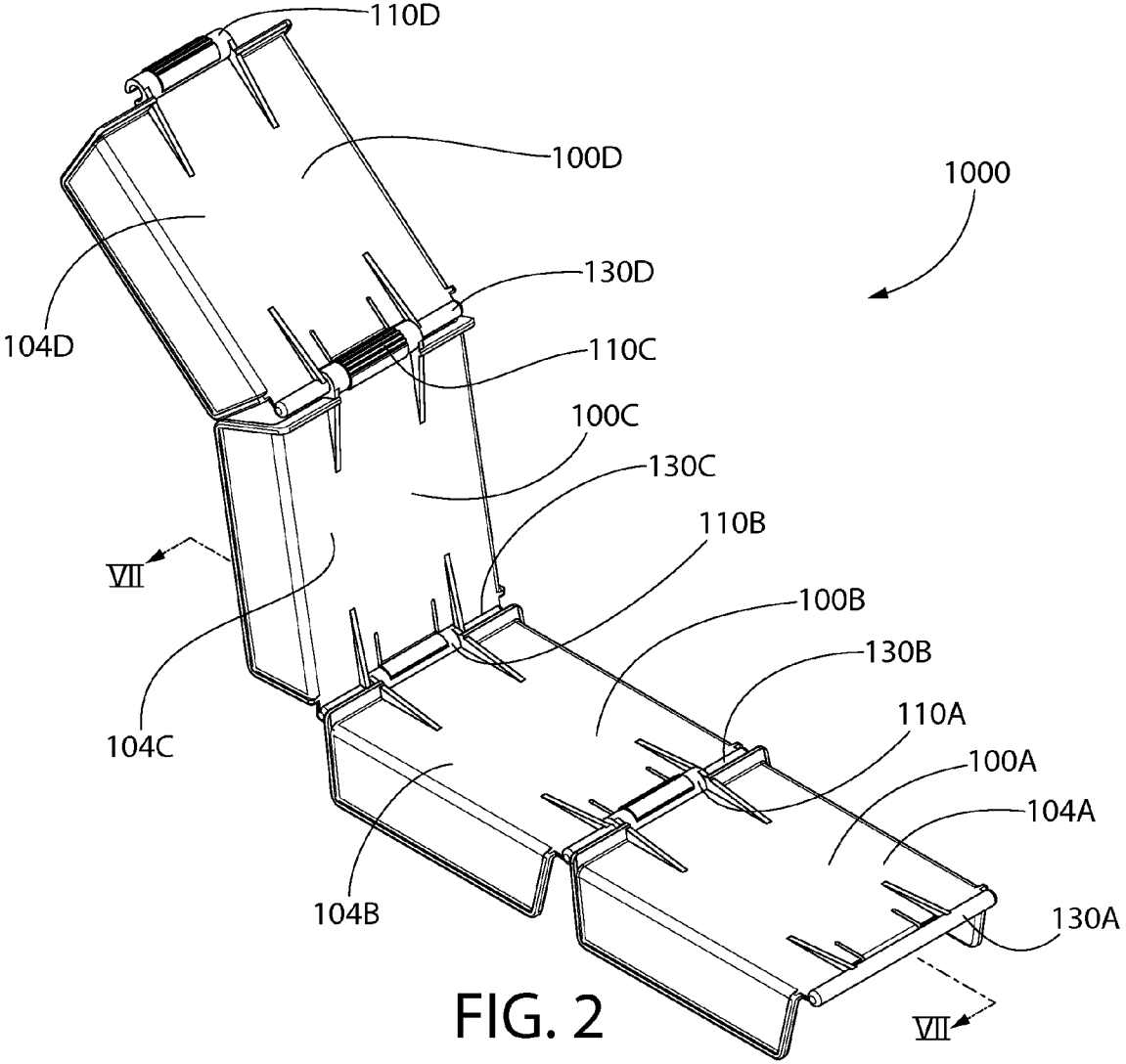
FIG. 2 is a rear perspective view of the track of FIG. 1.
Figure 3:
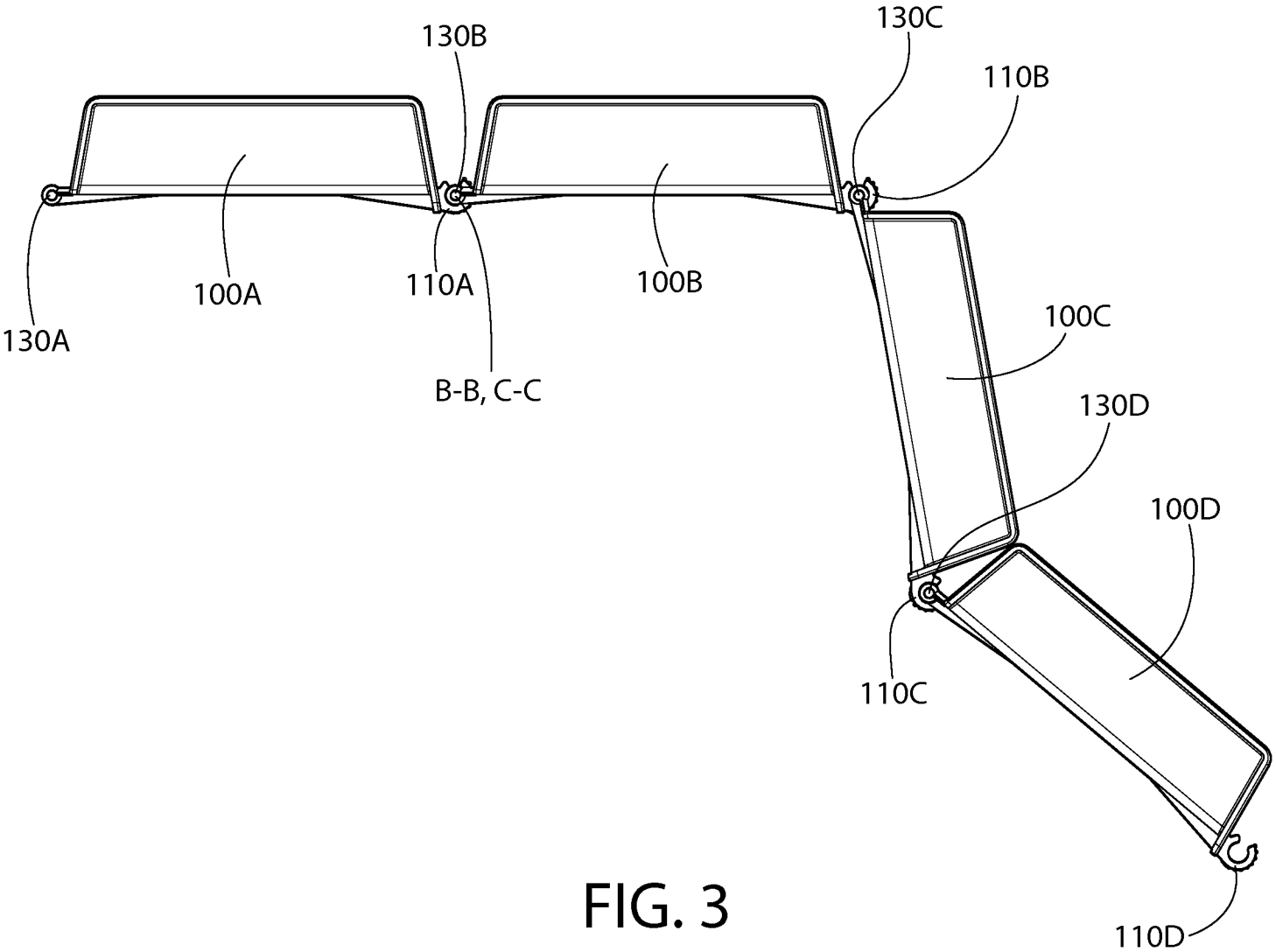
FIG. 3 is a side view of the track of FIG. 1.

Referring first to FIGS. 1-3 concurrently, a track 1000 for a toy vehicle will be described in accordance with an embodiment of the present invention. The track 1000 comprises a plurality of track sections 100A-D, each of which is identical in structure in the exemplified embodiment. Of course, the invention is not to be so limited in all embodiments and in certain other embodiments the track 1000 may include various track sections 100A-D having differences in their structure. In certain embodiments, the invention may be a single one of the track sections 100A-D and its structure. In other embodiments, the invention may be a track formed by two or more of the track sections 100A-D that can be coupled together in various manners to create/build the track 1000. In still other embodiments, the invention may be a kit that comprises two or more of the track sections 100A-D. As will be appreciated from the discussion that follows, the track sections 100A-D can be detachably coupled together and the angle at which the track sections 100A-D are positioned relative to adjacent ones of the track sections 100A-D can be readily/easily adjustable. The structure of the track sections 100A-D, described in more detail below, facilitates the adjustability of the track sections 100A-D relative to one another. Thus, the track sections 100A-D can be positioned in many different orientations relative to one another so that the track 1000 is dynamically modular in that the slopes of the surface upon which the toy vehicle rides along the track 1000 can be readily modified.

In order to appreciate the manner in which the track sections 100A-D are coupled together to form the track 1000, the first track section 100A will be described in detail with reference to FIGS. 4-6. Although the details are provided below with reference to the first track section 100A, it should be appreciated that these details also apply to the structure of the second track section 100B, the third track section 100C, and the fourth track section 100D. Thus, in the exemplified embodiment each of the track sections 100A-D has an identical structure, which is described herein below with reference to FIGS. 4-6 which depicts the first track section 100A. Of course, as noted above in certain embodiments there may be some differences among and between the various track sections 100A-D such that not all of the track sections 100A-D need to have the exact structure discussed below. Furthermore, although FIGS. 1-3 illustrate the track 1000 being formed by four track sections 100A-D, the invention is not to be so limited in all embodiments and the track 1000 may be firmed from any number of track sections as desired to form a track of desired length.

Figure 4:
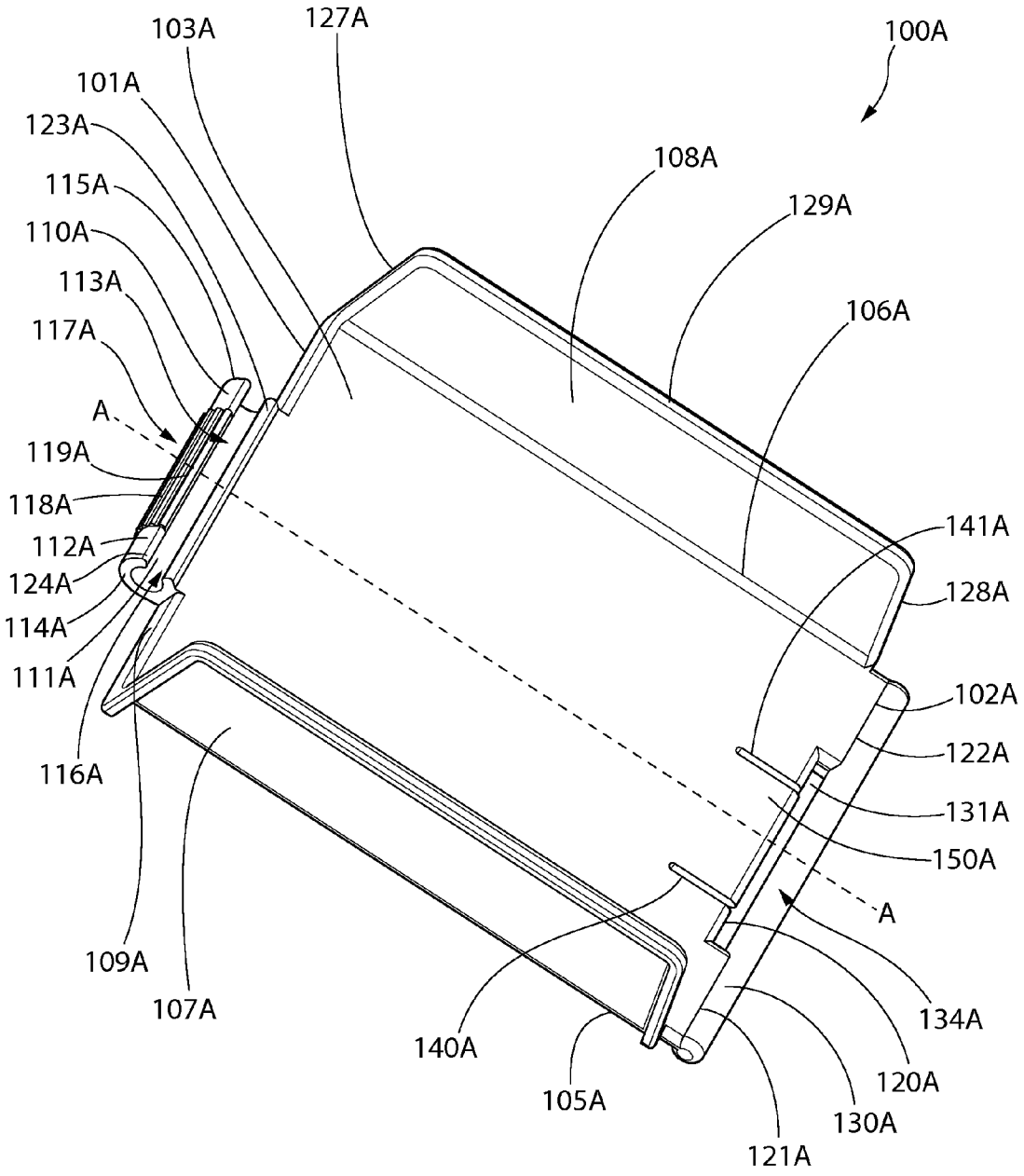
FIG. 4 is a top perspective view of a track section of the track of FIG. 1.
Figure 5:
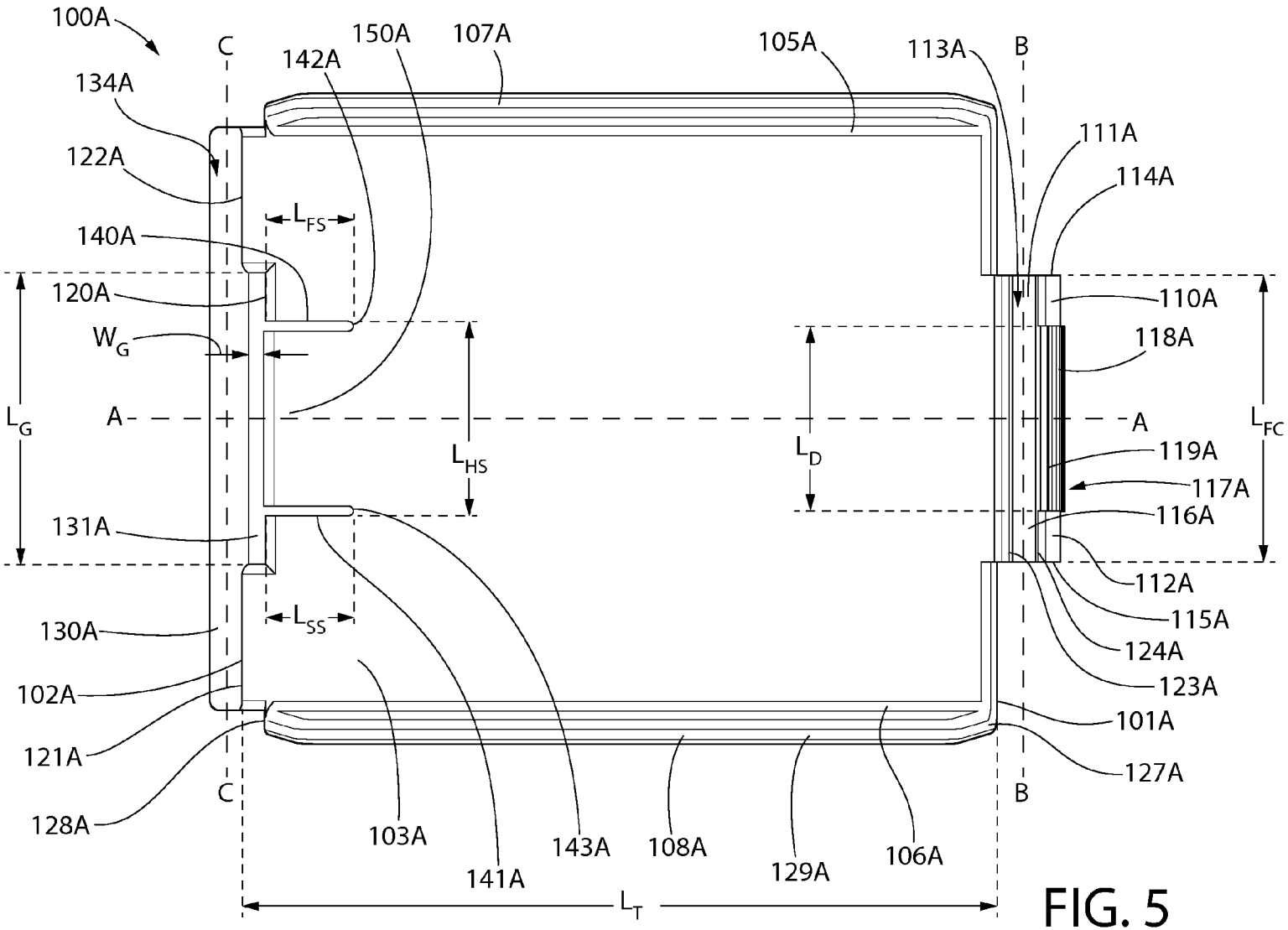
FIG. 5 is a top view of the track section of FIG. 4.
Figure 6:
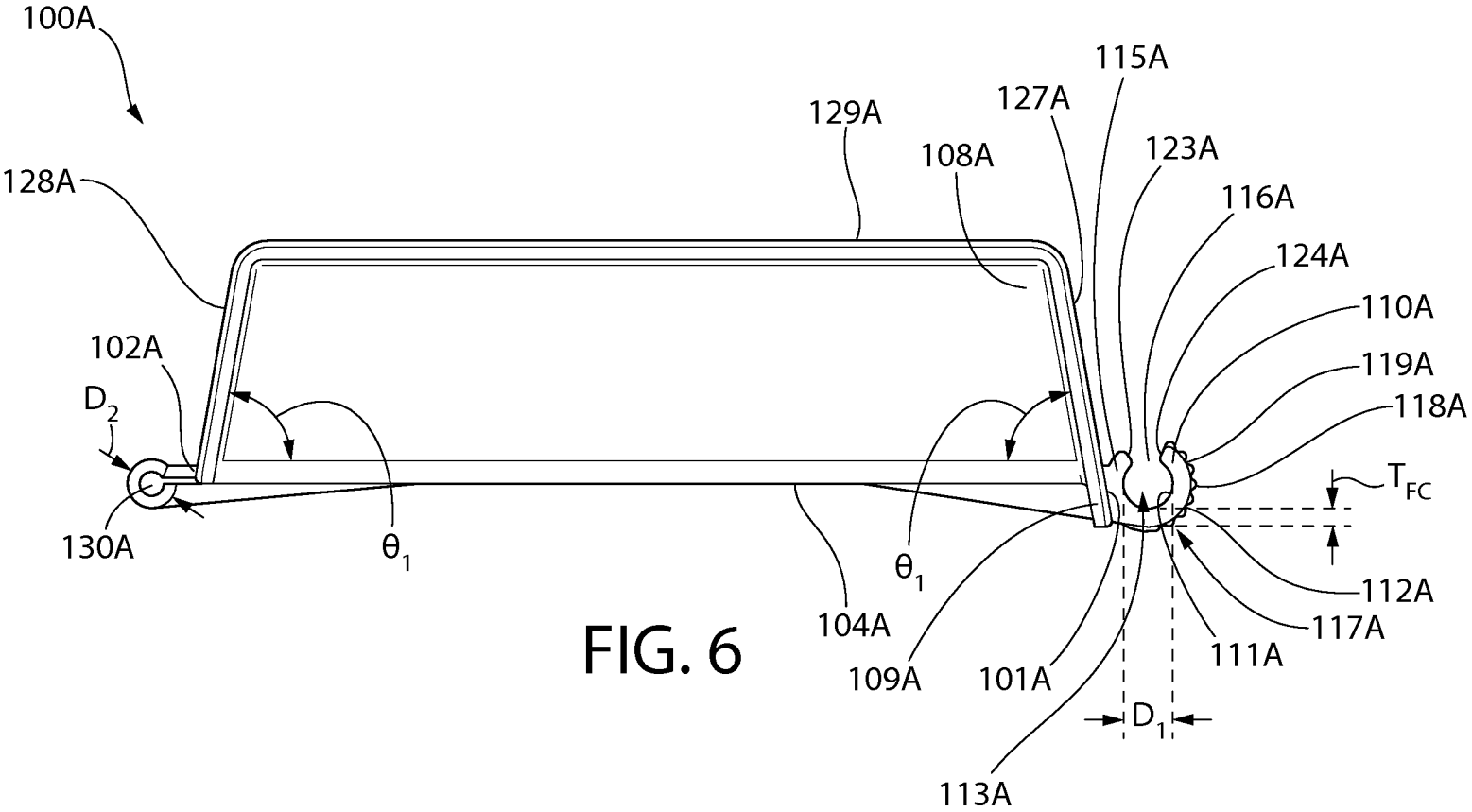
FIG. 6 is a side view of the track section of FIG. 4.

In FIGS. 4-6 each of the structural components of the first track section 100A will be denoted with a reference numeral followed by the suffix "A." Similar structures on the second, third, and fourth track sections 100B-D will be numbered with the same reference numeral followed by the suffixes "B," "C," and "D." Thus, the similar reference numerals refer to similar structural components, and although the components are not described with regard to each of the track sections 100A-D, it should be understood that the description of that component with regard to the first track section 100A is applicable to the similar structure on the other track sections 100B-D.

The first track section 100A comprises a first edge 101A, a second edge 102A, an upper surface 103A upon which the toy vehicles are supported during use, a lower surface 104A, a left-side edge 105A, and a right-side edge 106A. The first and second side edges 101A, 102A extend between the left-side edge 105A and the right-side edge 106A, and similarly the left and right side edges 105A, 106A extend between the first and second side edges 101A, 102A. The first and second side edges 101A, 102A are generally parallel to one another, the left-side edge 105A and the right-side edge 106A are generally parallel to one another, and the first and second edges 101A, 102B are generally perpendicular to the left and right-side edges 105A, 106A.

Thus, the upper surface 103A of the first track section 100A is generally rectangular or square in shape. Of course, the invention is not to be so limited, in all embodiments and the shape of the upper surface 103A can be circular or other polygonal shapes in other embodiments. Furthermore, in the exemplified embodiment the upper surface 103A of the first track section 100A is planar, although the upper surface 103A of the first track section 100A can be non-planar in other embodiments such as including hills and valleys to mimic different types of terrain. In certain embodiments, the first and second edges 101A, 102A have a length of approximately 55-75 cm and the left-side edge 105A and the right-side edge 106A have a length of approximately 75-95 cm, although the invention is not to be particularly limited by the length values provided herein in all embodiments.

The upper surface 103A of the first track section 100A extends along a longitudinal axis A-A from the first edge 101A to the second edge 102A. A first sidewall 107A extends upwardly from the left-side edge 105A of the first track section 100A away from the upper surface 103A and a second sidewall 108A extends upwardly from the right-side edge 106A of the first track section 100A away from the upper surface 103A. The sidewalls 107A, 108A extend across substantially the entirety of the left and right-side edges 105A, 106A. In the exemplified embodiment, the first and second sidewalls 107A, 108A extend upwardly at an acute angle $\theta_1$ relative to the upper surface 103A at the first and second edges 101A, 102A of the first track section 100A (see FIGS. 6 and 7). More specifically, each of the sidewalk 107A, 108A has a first side edge 127A, an opposing second side edge 128A, and a top edge 129A. Each of the first and second side edges 127A, 128A of each of the sidewalk 107A, 108A is oriented at the acute angle $\theta_1$ relative to the upper surface 103A.

In certain embodiments, the angle $\theta_1$ may be between 70° and 89°, more specifically between 75° and 85°, and still more specifically between 78° and 82°. Although both are denoted herein as $\theta_1$, in certain embodiments the angle formed between the first side edge 127A and the upper surface 103A may be different than the angle formed between the second side edge 128A and the upper surface 103A. In some embodiments, the angle formed between the first side edge 127A and the upper surface 103A may be smaller than the angle formed between the second side edge 128A and the upper surface 103A. Nonetheless, in the exemplified embodiment the sidewalls 107A, 108A have a substantially trapezoidal shape. In the exemplified embodiment, the major surfaces of the sidewalls 107A, 108A extend substantially perpendicularly from the upper surface 103A of the first track section 100A. However, in other embodiments the major surfaces of the sidewalls 107A, 108A may be slightly angled inwardly towards or outwardly away from each other.

The angled extension of the first and second side edges 127A, 128A of the first and second sidewalk 107A, 108A enhances the ability of adjacent ones of the track sections 100A-D that are coupled together to move relative to one another, as described in more detail below, by preventing collision between the first and second sidewalls 107A, 108A of adjacent ones of the track sections 100A-D until a certain angle is formed between the adjacent track sections 100A-D. In certain embodiments, the various track sections 100A-D may have differing widths (or the width of each track section 100A-D may change along its length) to prevent the first and second sidewalls 107A, 108A of adjacent ones of the track sections 100A-D from colliding, or the sidewalk 107A, 108A may be angled outwardly away from each other to varying degrees to achieve this purpose.

Furthermore, the first and second sidewalls 107A, 108A provide a boundary that assists in maintaining the toy vehicle on the track 1000 during use or play. Specifically, during use the toy vehicle travels in the direction of the longitudinal axis A-A from the first edge 101A to the second edge 102A or vice versa. During such direction of travel, the sidewalls 107A, 108A prevent the toy vehicle from falling over the left-side edge 105A and right-side edge 106A and direct the toy vehicle to move in the direction of the longitudinal axis A-A. The first and second edges 101A, 102A of the first track section 100A remain free of a sidewall so that the toy vehicle can freely pass over and beyond the first and second edges 101A, 102A of the first track section 100A and onto an adjacent track section (such as the second track section 100B depicted in FIG. 1).

The first track section 100A comprises a first connector 110A extending from the first edge 101A of the first track section 100A. More specifically, in the exemplified embodiment a lip 109A extends downwardly from the first edge 101A of the first track section 100A, and the first connector 110A is coupled directly to the lip 109A. In the exemplified embodiment, the first connector 110A is elongated along the first edge 101A of the first track section 100A and extends along a second longitudinal axis B-B that is substantially perpendicular to the first longitudinal axis A-A. Furthermore, the first edge 101A of the first track section 100A has a length that is greater than a length $L_{FC}$ of the first connector 110A. Thus, the first connector 110A is positioned centrally along the first edge 101A of the first track section 100A, although the invention need not be so limited in all embodiments. In some embodiments the first connector 110A may extend along the entirety of the length of the first edge 101A, and in other embodiments the first connector 110A may be shorter than the first edge 101A but may not be centrally positioned thereupon. Furthermore, the first connector 110A may have a length that is greater than the length of the first edge 101A in still other embodiments. In the exemplified embodiment the first connector 110A is integrally formed with the first track section 100A as a unitary structure, although in other embodiments the first connector 110A may be separately formed from and later coupled to the first track section 100A.

The first connector 110A comprises an inner surface 111A and an outer surface 112A. The inner surface 111A of the first connector 110A defines a receiving cavity 113A. Furthermore, in the exemplified embodiment, the inner surface 111A of the first connector 110A is a smooth surface that is free of ridges, bumps, protuberances, or the like. The first connector 110A extends along the first edge 101A of the first track section 100A from a first end 114A to a second end 115A. The first connector 110A comprises an elongated opening 116A that extends the entirety of the length of the first connector 110A from the first end 114A of the first connector 110A to the second end 115A of the first connector 110A. The elongated opening 116A is formed between opposing edges 123A, 124A of the first connector 110A. In the exemplified embodiment each of the opposing edges 123A, 124A and the elongated opening 116A are positioned above a plane that is coincident with the upper surface 103A of the first track section 100A. Furthermore, in the exemplified embodiment the edge 123A is located at a first height above the upper surface 103A and the edge 124A is located at a second height above the upper surface 103A, the second height being greater than the first height (this can best be seen in FIGS. 8 and 10). The plane that is coincident with the upper surface 103A of the first track section 100A intersects the first connector 110A and the receiving cavity 113A thereof.

The elongated opening 116A forms a passageway into the receiving cavity 113A of the first connector 110A. The receiving cavity 113A is an open space within which a second connector (described below) of another one of the track sections 100B-D can be positioned to couple the first track section 100A to another one of the track sections 100B-D. Thus, a second connector of another one of the track sections 100B-D can be inserted through the elongated opening 116A and into the receiving cavity 113A of the first connector 110A to couple the first track section 100A to another one of the track sections 100BD. In the exemplified embodiment, the receiving cavity 113A has a circular cross-sectional shape and a first diameter $D_1$.

The outer surface 112A of the first connector 110A comprises a plurality of detents 117A. In the exemplified embodiment, the plurality of detents 117A are formed by ribs 118A extending from the outer surface 112A of the first connector 110A. Specifically, in the exemplified embodiment a plurality of ribs 118A extend from the outer surface 112A of the first connector 110A and are elongated in the direction of the second longitudinal axis B-B. The ribs 118A are spaced apart from one another about the outer surface 112A of the first connector 110A so as to form channels 119A therebetween. The channels 119A act as detents for the purpose of securing adjacent ones of the track sections 100A-D to one another at a desired angular orientation. In the exemplified embodiment, the plurality of ribs 118A do not extend along the entirety of the length $L_{FC}$ of the first connector 110A. Rather, in the exemplified embodiment the plurality of ribs 118A are centrally located on the first connector 110A and terminate inward of the first and second ends 114A, 115A of the first connector 110A. Thus, in the exemplified embodiment the plurality of detents 117A (which in this embodiment is formed by the plurality of ribs 118A and channels 119A) extend a length $L_D$ that is less than the length $L_{FC}$ of the first connector 110A. Of course, the invention is not to be so limited in all embodiments and the plurality of ribs 118A may extend across the entire length $L_{FC}$ of the first connector 110A in other embodiments.

Although the plurality of detents 117A are described and illustrated herein as being formed by ribs 118A and channels 119A, the invention is not to be so limited. In certain other embodiments, the plurality of detents 117A may be formed by notches or indents (cutouts) that are formed into the outer surface 112A of the first connector 110A, teeth extending from the outer surface 112A of the first connector 110A, or the like. Alternatively, the plurality of detents 117A may be formed by protuberances or nubs extending from the outer surface 112A of the first connector 110A that are discrete in size rather than being elongated like the ribs 118A illustrated in the figures. Thus, the plurality of detents 117A can be formed by any structure that retains the adjacent ones of the track sections 100A-D at a desired angular orientation relative to one another while permitting the relative angular orientation to be adjusted without detaching the adjacent track sections 100A-D from one another, as will be described in more detail below with specific reference to FIGS. 7-10. Specifically, the plurality of detents 117A can be formed by any structure that holds one of the track sections 100A-D in relation to another one of the track sections 100A-D in a manner such that the hold can be released by force applied to one of the track sections 100A-D.

In the exemplified embodiment, there are seven of the detents 117A provided on the outer surface 112A of the first connector 110A. Of course, the invention is not to be limited by the number of detents 117A depicted in the drawings, and more or less than seven detents 117A may be used in other embodiments to provide more adjustability/versatility in the formation of the track 1000 created using the track sections 100A-D. Furthermore, in the exemplified embodiment a first portion of the outer surface 112A of the first connector 110A comprises the plurality of detents 117A and a second portion of the outer surface 112A of the first connector 110A is free of the detents 117A. Specifically, the detents 117A are formed into the portion of the outer surface 112A of the first connector 110A between the edge 124A that is furthest from the first edge 101A to a transition point, and there are no detents 117A from the transition point to the edge 123A that is closest to the first edge 101A. Thus, in the exemplified embodiment approximately half of the outer surface 112A of the first connector 110A is free of the detents 117A. In other embodiments, the entirety of the outer surface 112A of the first connector 110A may include detents 117A.

In the exemplified embodiment, the first connector 110A has a C-shaped cross-sectional profile. Thus, in the exemplified embodiment the inner surface 111A of the first connector 110A is a concave surface and the outer surface 112A of the first connector 110A is a convex surface. Of course, the invention is not limited to the first connector 110A having a C-shaped cross-sectional profile in all embodiments and other cross-sectional profiles and shapes are possible within the scope of the present invention in alternative embodiments.

The second edge 102A of the first track section 100A has a stepped surface such that the second edge 102A of the first track section 100A comprises a first portion 120A, a second portion 121A, and a third portion 122A. The first portion 120A of the second edge 102A is positioned between the second and third portions 121A, 122A of the second edge 102A. Furthermore, the first portion 120A of the second edge 102A is set inwardly from the second and third portions 121A, 122A of the second edge 102A such that the length of the first track section 100A from the first edge 101A to the first portion 120A of the second edge 102A is less than the length of the first track section 100A from the first edge 101A to the second and third portions 121A, 122A of the second edge 102A.

The first track section 100A comprises a second connector 130A extending from the second edge 102A of the first track section 100A. The second connector 130A extends along the second edge 102A of the first track section 100A along a third longitudinal axis C-C. The third longitudinal axis C-C is substantially parallel to the second longitudinal axis B-B of the first connector 110A and substantially perpendicular to the first longitudinal axis A-A of the first track section 100A. In the exemplified embodiment, the second connector 130A is coupled directly to the second and third portions 121A, 122A of the second edge 102A of the first track section 100A. However, the second connector 130A is spaced apart from the first portion 120A of the second edge 102A of the first track section 100A by a gap 131A due to the stepped nature of the second edge 102A described above. In the exemplified embodiment the second connector 130A is integrally formed with the first track section 100A as a unitary structure; however, the invention is not to be so limited and the second connector 130A may be separately formed from the first track section 100A and later coupled thereto during manufacturing.

The second connector 130A is cylindrical in shape and extends along the entirety of the second edge 102A of the first track section 100A from the left-side edge 105A of the first track section 100A to the right-side edge 106A of the first track section 100A. However, the invention is not to be so limited and the second connector 130A need not extend across the entirety of the second edge 102A of the first track section 100A in all embodiments. Furthermore, the second connector 130A has a second diameter $D_2$. In certain embodiments, the second diameter $D_2$ is substantially equal to or slightly less than the first diameter $D_1$ of the receiving cavity 113A so that the second connector 130A of the first track section 100A can fit within the receiving cavity 113B-D of the first connector 110B-D of another one of the track sections 100B-D as depicted in FIGS. 1-3 and 7-10. The second connector 130A has a smooth outer surface 134A that is free of bumps, ridges, or protuberances so that the second connector 130A-D of one of the track sections 100A-D can freely rotate within the receiving cavity 130A-D of another one of the track sections 100A-D.

Although in the exemplified embodiment the plurality of detents 117A are formed on the outer surface 111A of the first connector 110A, in other embodiments the detents may be formed on one of the inner surface 112A of the first connector 110A or the outer surface 134A of the second connector 130A. Specifically, one of the inner surface 112A of the first connector 110A and the outer surface 134A of the second connector 130A may include one or more ridges, protuberances, or the like, and the other of the inner surface 112A of the first connector 110A and the outer surface 134A of the second connector 130A may include one or more notches, indents, or the like. The ridges/protuberances on one of the first and second connectors 110A, 130A of a first track section 100A can mate with the notches/indents on the other one of the first and second connectors 110B, 130B of a second track section 100B to facilitate temporarily locking the first and second track sections 100A, 100B into a desired relative position.

As will be appreciated from the discussion of FIGS. 7-10 below, the gap 131A provides a location for the first connector 110A to extend into when the first connector 110A of the first track section 100A is coupled to the second connector 130B-D of an adjacent one of the track sections 100B-D. In that regard, the gap 131A has a width $W_G$ measured from the first portion 120A of the second edge 102A to the second connector 130A. Furthermore, the first connector 110A has a thickness $T_{FC}$ measured from the inner surface 111A of the first connector 110A to the outer surface 112A of the first connector 110A. The thickness $T_{FC}$ of the first connector 110A is less than or equal to the width $W_G$ of the gap 131A. Furthermore, the gap 131A has a length $L_G$ measured along the second edge 102A of the first track section 110A. The length $L_G$ of the gap 131A is greater than or equal to, but preferably slightly greater than, the length $L_{FC}$ of the first connector 110A. As a result of the aforementioned dimensions of the gap 131A and the first connector 110A, the first connector 110A of one of the track sections 100A-D is able to protrude into the gap 131A of another one of the track sections 100A-D when the two track sections 100A-D are detachably coupled together.

A first slot 140A is formed into the first track section 100A and extends from the second edge 102A of the first track section 100A towards the first edge 101A of the first track section 100A. Furthermore, a second slot 141A is formed into the first track section 100A and extends from the second edge 102A of the first track section 100A towards the first edge 101A of the first track section 100A. More specifically, each of the first and second slots 140A, 141A extends from the first portion 120A of the second edge 102A of the first track section 100A. In the exemplified embodiment, each of the first and second slots 140A, 141A extends along an axis that is parallel to the first longitudinal axis A-A of the first track section 100A. Furthermore, the first slot 140A is spaced apart from the second slot 141A in a direction transverse to the longitudinal axis A-A such that a hinge section 150A is formed into the first track section 100A in between the first and second slots 140A, 141A. The hinge section 150A has a length $L_{HS}$ measured from the first slot 140A to the second slot 141A. The length $L_{HS}$ of the hinge section 150A is approximately equal to or slightly greater than the length $L_D$ of the plurality of detents 117A of the first connector 110A. The hinge section 150A comprises at least a portion of the first portion 120A of the second edge 102A of the first track section 100A.

In the exemplified embodiment, each of the first and second slots 140A, 141A are formed through the first track section 100A from the upper surface 103A to the lower surface 104A thereby forming an elongated aperture that extends through the first track section 100A. Thus, the hinge section 150A of the first track section 100A has an added resiliency or flexibility such that the hinge section 150A defined between the first and second slots 140A, 141A can flex upwardly and downwardly relative to the upper and lower surfaces 103A, 104A. This flexibility of the hinge section 150A facilitates the relative movement between the adjacently coupled track sections 100A-D for adjustment as described above and in more detail below.

In certain embodiments, the track sections 100A-D are all formed of a plastic material, such as polyester, polyethylene terephthalate, polyethylene, polyvinyl chloride, polypropylene, polystyrene, or the like. Although being generally rigid and hard, such plastic materials have some degree of flexibility, the degree of which is dependent upon the thickness of the material, the particular material selected, and the like. The slots 140A, 141A on either end of the hinge section 150A permit the hinge section 150A an added degree of flexibility that would not otherwise be available with the absence of the slots 140A, 141A. Specifically, the application of pressure on the upper surface 103A in the direction of the lower surface 104A or on the lower surface 104A in the direction of the upper surface 103A in the area of the hinge section 150A will result in the hinge section 150A moving upwardly and downwardly relative to the remainder of the first track section 100A. Moreover, although described herein as being formed of a plastic material, the track sections 100A-D can be formed of other materials as desired, such as metal, wood, elastomers, paper products, and the like.

In the exemplified embodiment, the first slot 140A has a length $L_{FS}$ measured from the first portion 120A of the second edge 102A to a distal end 142A and the second slot 141A has a length $L_{SS}$ measured from the first portion 120A of the second edge 102A to a distal end 143A. Furthermore, the first track section 100A has a length $L_T$ measured from the first edge 101A to the second edge 102A. In the exemplified embodiment, the length $L_{FS}$ is substantially equal to the length $L_{SS}$, although the invention is not to be so limited in all embodiments. Furthermore, a ratio of the length $L_T$ of the first track section 100A to the lengths $L_{FS}$, $L_{SS}$ of the slots 140A, 141A is between 7:1 and 10:1, more specifically between 7.5:1 and 9.5:1, and still more specifically between 8:1 and 8.5:1. Of course, these ratios are merely exemplary in nature and ratios outside of these ranges can be used in some embodiments.

Although the exemplified embodiment includes the slots 140A, 141A to form the hinge section 150A to increase the flexibility of the first portion 120A of the second edge 102A, the slots 140A, 141A can be omitted in some embodiments without affecting the functionality/coupling of the track sections 100A-D. Specifically, even without the slots 140A, 141A, the first portion 120A of the second edge 102A may have sufficient flexibility to be capable of entering into and flexing out of the various ones of the plurality of detents 117A during adjustment of the angles formed between the upper surfaces 103A, 103B of the adjacent ones of the track sections 100A, 100B. However, the slots 140A, 141A increase the flexibility and ensure that the adjustment features described herein can be readily achieved even by a child who is building a track 1000 with the track sections 100A-D.

Referring again briefly to FIGS. 1-3 concurrently, the track 1000 is illustrated with the first track section 100A coupled to the second track section 100B, the second track section 100B coupled to the third track section 100C, and the third track section 100C coupled to the fourth track section 100D. More specifically, the first connector 110A of the first track section 100A is detachably coupled to the second connector 130B of the second track section 100B. The first connector 110B of the second track section 100B is detachably coupled to the second connector 130C of the third track section 100C. The first connector 110C of the third track section 100C is detachably coupled of the second connector 130D of the fourth track section 100D. In this embodiment, the second connector 130A of the first track section 100A and the first connector 110D of the fourth track section 100D remain free of connection to another one of the track sections, and thus, the first and fourth track sections 100A, 100D form the opposing ends of the track 1000. Of course, additional track sections can be added to the track 1000 by connecting such additional track sections to one or both of the first and fourth track sections 100A, 100D. As can be seen in FIG. 2, to provide strength and rigidity to the first and second connectors 110A-D, 130A-D of each of the track sections 100A-D, each of the first and second connectors 110A-D, 130A-D is coupled to a rib that extends along the lower surface 104A-D of the respective track section 100A-D.

The coupling of the various track sections 100A-D to one another will be described below with reference to the coupling of the first and second track sections 100A-B to one another, it being understood that the same discussion applies to coupling of the other track sections to one another. To couple the first and second track sections 100A-B together as depicted in FIGS. 1-3, the second connector 130B of the second track section 100B is press-fit through the elongated opening 116A of the first connector 110A of the first track section 100A. This causes the first connector 110A of the first track section 100A to flex a sufficient amount to enable the second connector 130B of the second track section 100B to enter into and come to rest within the receiving cavity 113A of the first connector 110A of the first track section 100A. Once so positioned, the second connector 130B of the second track section 100B can be rotated within the first connector 110A of the first track section 100A about the longitudinal axes B-B, C-C, which are coincident when the first and second track sections 100A-B are coupled together as noted above. Thus, the longitudinal axes B-B, C-C form a rotational axis about which the first and second track sections 100A-B can be rotated relative to one another.

As can be seen in FIGS. 1-3, and as is best seen in FIG. 3, the adjacent track sections 100A-D are positioned at different orientations relative to one another, and these orientations are adjustable without detaching the adjacent track sections 100A-D from one another. Specifically, the upper surfaces 103A, 103B of the first and second track sections 100A, 100B are positioned at one orientation (approximately 180° relative to one another), the upper surfaces 103B, 103C of the second and third track sections 100B, 100C are positioned at another orientation (approximately 90° relative to one another), and the upper surfaces 103C, 103D of the third and fourth track sections 100C, 100D are positioned at yet another orientation (approximately 45° relative to one another). The orientation between the first and second track sections 100A, 100B can be adjusted by rotating the first track section 100A relative to the second track section 100B or rotating the second track section 100B relative to the first track section 100A about the rotational axis that is coincident with the longitudinal axis C-C of the second connector 130B of the second track section 100B and the longitudinal axis B-B of the first connector 110A of the first track section 100A.

Referring to FIGS. 7-10 concurrently, the relative positioning between the first and second track sections 100A, 100B when detachably coupled together and the possible movement of the first and second track sections 100A, 100B relative to one another will be described. As noted above, the first and second track sections 100A, 100B are detachably coupled together by the second connector 130B of the second track section 100B being positioned within the receiving cavity 113A of the first connector 110A of the first track section 100A. The second connector 130B of the second track section 100B is able to rotate within the receiving cavity 113A of the first connector 110A of the first track section 100A due to the smooth abutting surfaces of the outer surface 134B of the second connector 130B of the second track section 100B and the inner surface 111A of the first connector 110A of the first track section 100A. When so positioned, the first connector 110A of the first track section 100A extends into the gap 131B located between the second connector 130B of the second track section 100B and the first portion 120B of the second edge 102B of the second track section 100B. Furthermore, in this position the first portion 120B of the second edge 102B of the second track section 100B is positioned within a first one 161A of the plurality of detents 117A of the first connector 110A of the first track section 100A.

The first and second track sections 100A-B are rotatably coupled together about a rotational axis that is coincident with the longitudinal axis B-B of the first connector 110A of the first track section 100A and the longitudinal axis C-C of the second connector 130B of the second track section 100B. However, due to the cooperation between the detents 117A, and specifically the first one of the detents 161A of the first connector 110A of the first track section 100A, and the first portion 120B of the second edge 102B of the second track section 100B, relative movement between the first and second track sections 100A-B is prevented unless or until a rotational force is applied to one of the first and second track sections 100A-B. Specifically, in the exemplified embodiment the relative positioning of the first and second track sections 100A, 100B is temporarily locked into place by virtue of the first portion 120B of the second edge 102B of the second track section 100B being trapped within one of the channels 119A between adjacent ribs 118A of the first connector 110A of the first track section 100A. A force is required in order to enable the first portion 120B of the second edge 102B of the second track section 100B to pass over one of the ribs 118A that it is trapped between so as to enter into a different one of the channels 119A.

As noted above, the first portion 120B of the second edge 102B of the second track section 100B is formed as a part of the hinge section 150B, and thus it is flexible upwardly and downwardly as desired. Thus, if it is desired to change the relative orientations of the first and second track sections 100A-B, a user can hold one of the first and second track sections 100A-B motionless and rotate the other one of the first and second track sections 100A-B about the rotational axis (i.e., about the axes B-B, C-C). During such rotation of the other one of the first and second track sections 100A-B, the hinge section 150B of the second track section 100B will flex upwardly or downwardly and will pass over one of the ribs 118A that was holding the first portion 120B of the second edge 102B of the second track section 100B within the first one 161A of the plurality of detents 117A. After passing over one (or more) of the ribs 118A, the first portion 120B of the second edge 102B of the second track section 100B will come to rest within a second one 162A of the plurality of detents 117A (see FIGS. 9 and 10).

Figure 7:
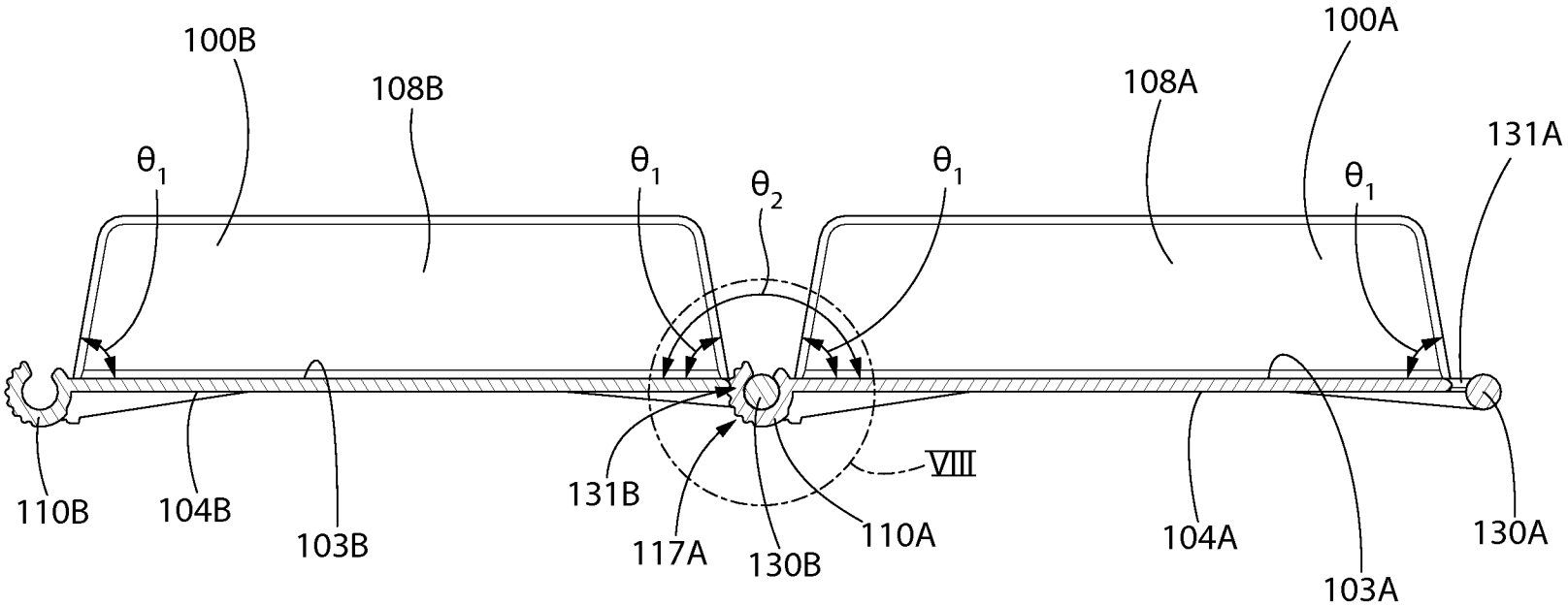
FIG. 7 is a cross-sectional view taken along line of FIG. 2 with first and second track sections in a first position.
Figure 8:
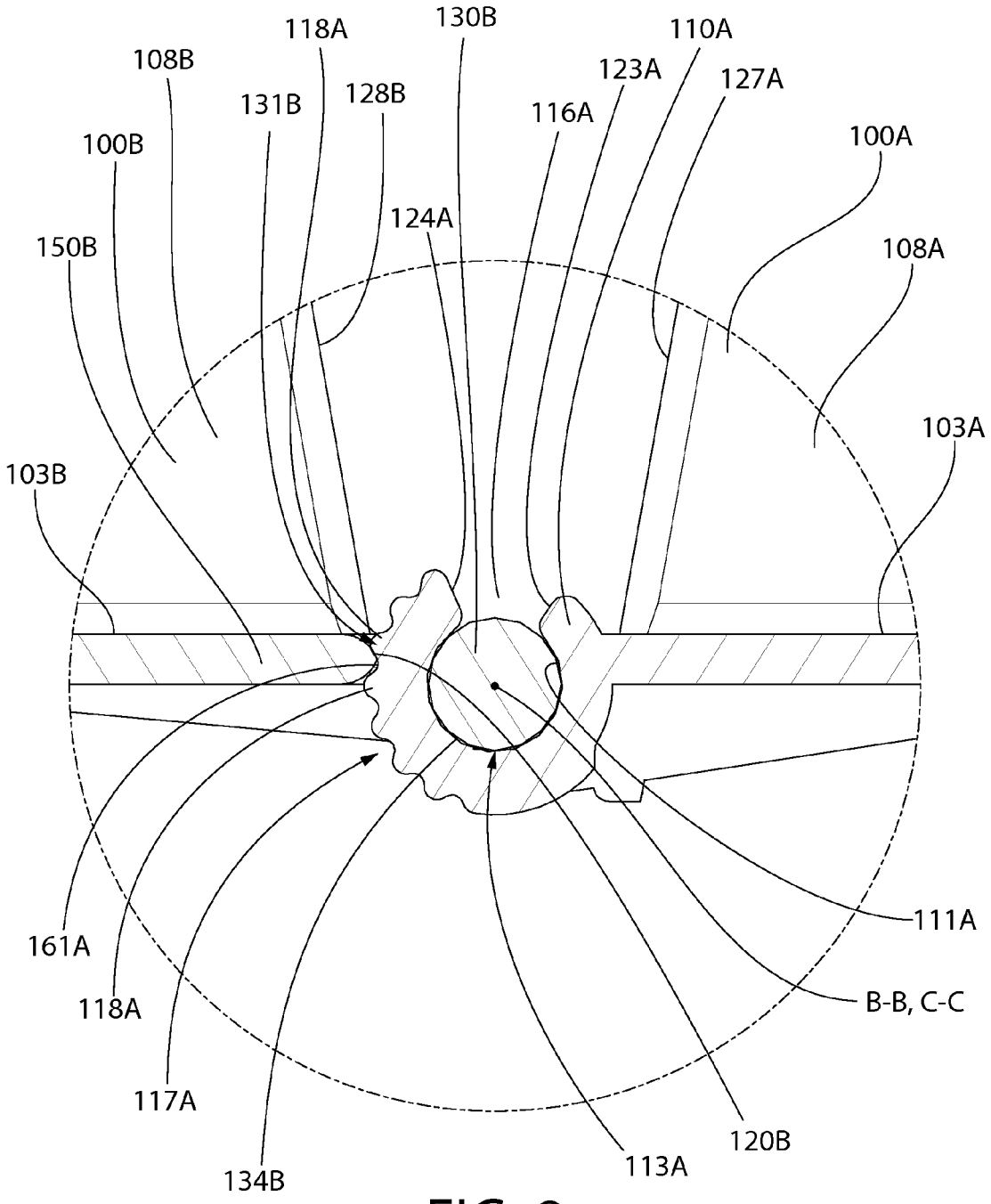
FIG. 8 is a close-up of area VIII of FIG. 7.
Figure 9:
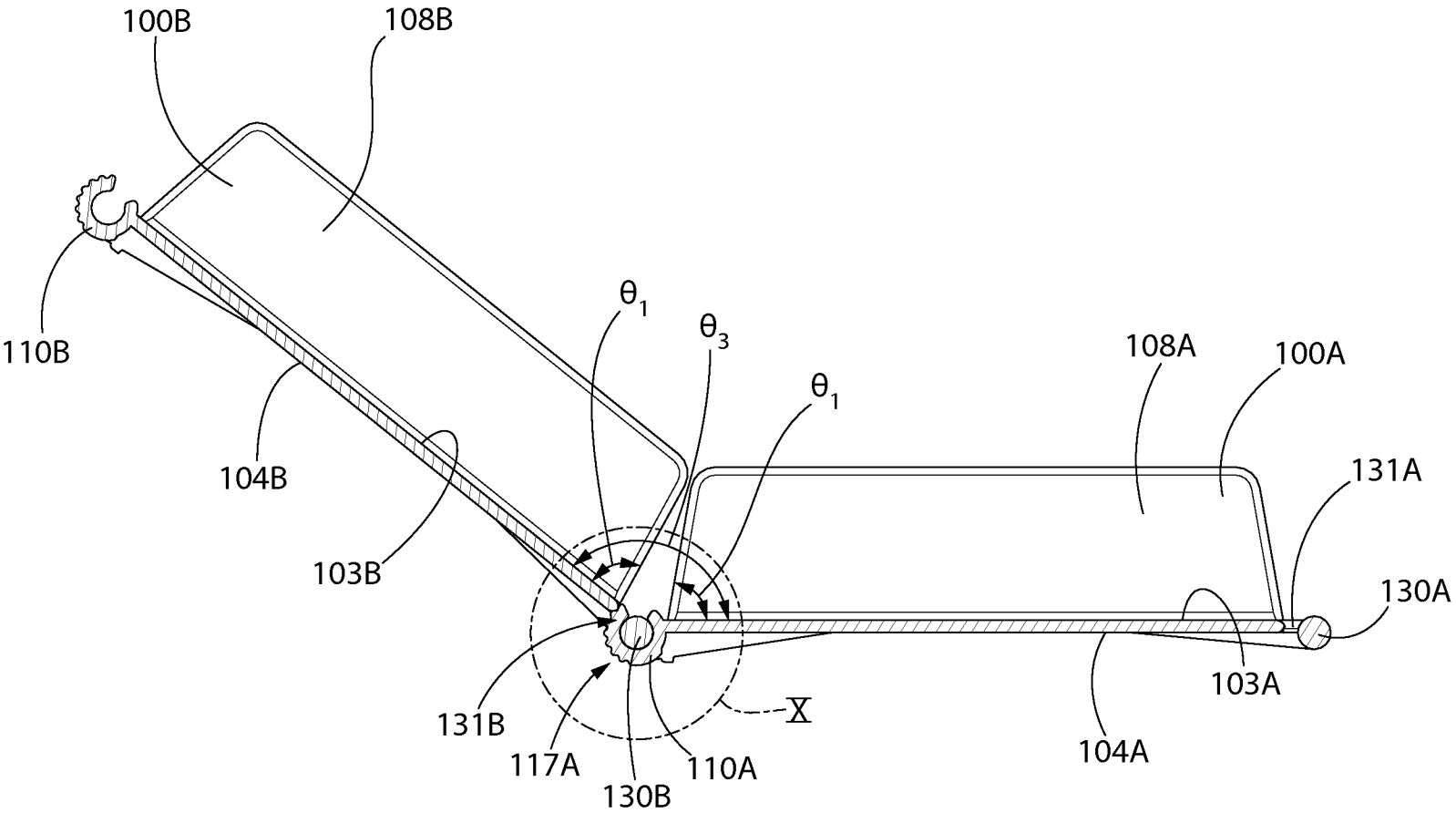
FIG. 9 is the cross-sectional view of FIG. 7 with the first and second track sections in a second position.
Figure 10:
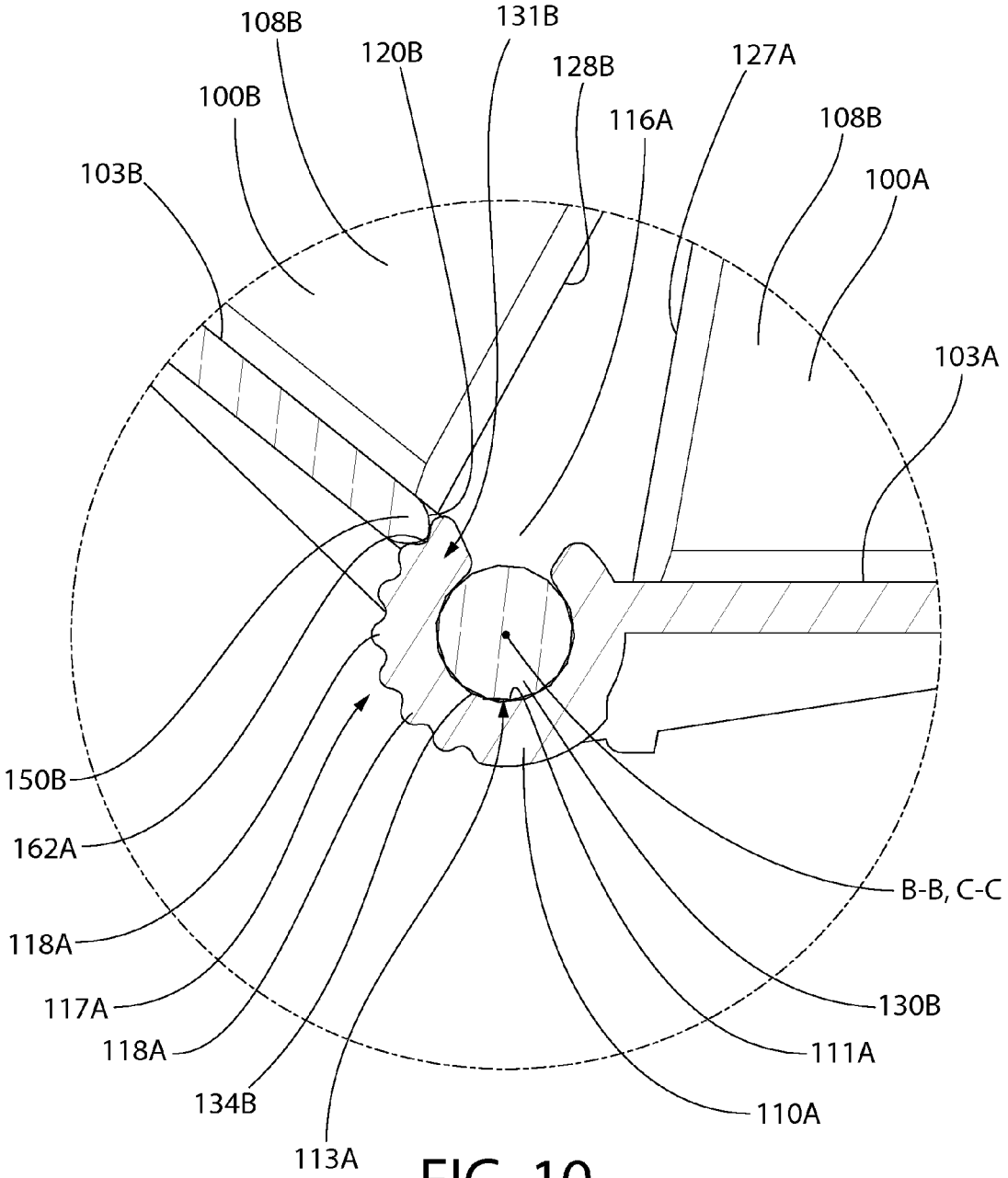
FIG. 10 is a close-up of area X of FIG. 9.

Thus, it should be appreciated that an angle between the upper surface 103A of the first track section 100A and the upper surface 103B of the second track section 100B is adjustable by rotating the first and second track sections 100A, 100B relative to one another about the rotational axis. Furthermore, rotation about the rotational axis causes the first portion 120B of the second edge 102B of the second track section 100B to be removed from the first one 161A of the plurality of detents 117A of the first connector 110A of the first track section 100A and positioned within the second one 162A of the plurality of detents 117A of the first connector 110A of the first track section 100A. Thus, the first and second track sections 100A, 100B are adjustable between: (1) a first position (see FIGS. 7 and 8) in which the first portion 120B of the second edge 102B of the second track section 100B is positioned within the first one 161A of the plurality of detents 117A of the outer surface 112A of the first connector 110A of the first track section 100A; and (2) a second position (see FIGS. 9 and 10) in which the first portion 120B of the second edge 102B of the second track section 100B is positioned within a second one 162A of the plurality of detents 117A of the outer surface 112A of the first connector 110A of the first track section 100A. In the first position, an angle $\theta_2$ is formed between the upper surfaces 103A, 103B of the first and second track sections 100A, 100B. In the second position, an angle $\theta_3$ (the angle $\theta_3$ being different than the angle $\theta_2$) is formed between the upper surfaces 103A, 103B of the first and second track sections 100A, 100B. Referring to FIGS. 7 and 8, the angle $\theta_2$ between the upper surfaces 103A, 103B of the first and second track sections 100A, 100B is approximately 180°. Referring to FIGS. 9 and 10, the angle $\theta_3$ between the upper surfaces 103A, 103B of the first and second track sections 100A, 100B is approximately 140°. This angle can be changed by changing the specific one of the plurality of detents 117A of the first connector 110A that the first portion 120B of the second connector 130B is positioned within in the manner noted above.

Referring to FIGS. 9 and 10 concurrently, it should be appreciated that the angle $\theta_1$ that the sidewalls 108A, 108B extend from the upper surface 103A, 103B prevents over-rotation of the first and second track sections 100A, 100B relative to one another. Specifically, as depicted in FIGS. 9 and 10, the second one 162A of the plurality of detents 117A is the last one of the plurality of detents 117A on the first connector 110A. If the second track section 100B were to continue to rotate relative to the first track section 100A in a clockwise direction, the first portion 120B of the second edge 102B of the second track section 100B would be completely removed from the plurality of detents 117A of the first connector 110A of the first track section 100A. However, due to the angle $\theta_1$ of the sidewalls 108A, 108B, when the first portion 120B of the second edge 102B of the second track section 100B is within the second one 162A of the plurality of detents 117A, the sidewall 108B of the second track section 100B contacts the sidewall 108A of the first track section 100A and prevents further rotation of the second track section 100B relative to the first track section 100A in the clockwise direction. Thus, in addition to preventing a toy vehicle from falling off the sides of the track 1000, the sidewalls also serve a purpose in regards to preventing over-rotation of the track sections 100A-B relative to one another.

Referring again briefly to FIGS. 1-3, after the track 1000 is formed by coupling a desired number of the track sections 100A-D together and orienting the track sections 100A-D as desired, a toy vehicle can be positioned so that the wheels of the toy vehicle are in rolling engagement with the upper surfaces 103A-D of the track sections 100A-D. The toy vehicle can then ride along the track 1000 from the first track section 100A to the second track section 100B to the third track section 100C to the fourth track section 100D (or in the opposite direction). In certain embodiments the toy vehicle has four wheels that are spaced apart in the width direction a distance that is greater than the length of the first connectors 110A-D so that the wheels do not roll directly over the first connectors 110A-D. However, the first connectors 110A-D are sufficiently minimal in height that toy vehicles can roll directly thereupon if desired.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A track for a toy vehicle comprising:

a first track section and a second track section each having a first edge, a second edge, and an upper surface for supporting a toy vehicle extending between the first and second edges;

a first connector extending from the first edge of the first track section, the first connector comprising an inner surface that defines a receiving cavity;

a second connector extending from the second edge of the second track section;

wherein the first and second track sections are rotatably coupled together by positioning the second connector of the second track section within the receiving cavity of the first connector of the first track section;

wherein the upper surfaces of the first and second track sections and the first and second connectors collectively form a track surface configured for engagement with a toy vehicle positioned thereon; and wherein the first and second track sections are temporarily lockable in multiple relative positions with the upper surfaces thereof oriented at different angles relative to one another.

2. The track of claim 1 wherein the first track section extends along a first longitudinal axis, the first connector extends along a second longitudinal axis, and the second connector extends along a third longitudinal axis, the second and third longitudinal axes being parallel to each other and perpendicular to the first longitudinal axis, and wherein the first and second track sections are rotatably coupled together about a rotational axis that is coincident with the third longitudinal axis of the second connector.

3. The track of claim 2 wherein an angle between the upper surface of the first track section and the upper surface of the second track section is adjustable by rotating the first and second track sections relative to one another about the rotational axis.

4. The track of claim 1 wherein one of the inner surface of the first connector of the first track section and an outer surface of the second connector of the second track section comprises ridges and the other of the inner surface of the first connector of the first track section and the outer surface of the second connector of the second track section comprises notches, and wherein the ridges of the one of the inner surface of the first connector of the first track section and the outer surface of the second connector of the second track section mate with the notches of the other of the inner surface of the first connector of the first track section and the outer surface of the second connector of the second track section to temporarily lock the first and second track sections into a desired relative position.

5. The track of claim 1 wherein the first track section extends along a first longitudinal axis and the first connector of the first track section extends along a second longitudinal axis that is perpendicular to the first longitudinal axis, the first connector having a length measured along the second longitudinal axis that is less than a length of the first edge measured in a direction of the second longitudinal axis.

6. The track of claim 1 wherein each of the first and second track sections extends along a first longitudinal axis from the first edge to the second edge, and wherein each of the first and second track sections further comprises a left-side edge, a right-side edge, a first sidewall extending upwardly from the left-side edge in a direction away from the upper surface, and a second sidewall extending upwardly from the right-side edge in a direction away from the upper surface.

7. The track of claim 6 wherein the first track section comprises a third connector extending from the second edge of the first track section, the first connector protruding from the first edge of the first track section in a direction of the first longitudinal axis and the third connector protruding from the second edge of the first track section in a direction of the first longitudinal axis.

8. The track of claim 6 wherein each of the first and second sidewalls extends from a first edge to an opposing second edge, and wherein the first connector extends beyond the first edge of the first and second sidewalls in a direction of the first longitudinal axis and the second connector extends beyond the second edge of the first and second sidewalls in a direction of the first longitudinal axis.

9. The track of claim 1 wherein the first connector is elongated along the first edge of the first track section and has a C-shaped transverse cross-sectional profile, an outer surface of the first connector being convex.

10. The track of claim 9 wherein the first connector comprises an elongated opening extending from a first end of the first connector to a second end of the first connector, the elongated opening lying on a plane that is substantially parallel to the upper surface of the first track section and forming a passageway into the receiving cavity of the first connector, and wherein the first and second track sections are detachably coupled together by inserting the second connector of the second track section into the receiving cavity of the first connector of the first track section through the elongated opening of the first connector of the first track section.

11. The track of claim 1 further comprising:

a third connector extending from the second edge of the first track section, the third connector being spaced apart from the second edge of the first track section by a second gap; and a fourth connector extending from the first edge of the second track section, the fourth connector comprising an inner surface that defines a receiving cavity.

12. A track section for a toy vehicle track comprising:

a first edge, a second edge, and an upper surface for supporting a toy vehicle extending between the first and second edges, the track section having a first longitudinal axis extending from the first edge to the second edge;

a first connector extending from the first edge along a second longitudinal axis, the first connector comprising an inner surface that defines a receiving cavity and an outer surface comprising a plurality of detents;

a second connector extending from the second edge along a third longitudinal axis, the second connector being spaced apart from a portion of the second edge by a gap; and first and second slots extending from the second edge towards the first edge to form a hinge section of the track section between the first and second slots, the hinge section comprising the portion of the second edge of the track section.

13. The track section of claim 12 wherein the plurality of detents are formed by one of notches formed into the outer surface of the first connector or ribs extending from the outer surface of the first connector.

14. The track section of claim 12 wherein the first connector is elongated along the first edge of the track section and has a C-shaped transverse cross-sectional profile, an elongated opening extending from a first end of the first connector to a second end of the first connector, the elongated opening forming a passageway into the receiving cavity of the first connector, the outer surface of the first connector being convex.

15. The track section of claim 12 further comprising a left-side edge, a right-side edge, a first sidewall extending upwardly from the left-side edge in a direction away from the upper surface, and a second sidewall extending upwardly from the right-side edge in a direction away from the upper surface, wherein each of the first and second sidewalls comprises a first side edge adjacent to the first edge of the track section and a second side edge adjacent to the second edge of the track section, each of the first and second side edges of the first and second sidewalls oriented at an acute angle relative to the upper surface of the track section.

16. A track for a toy vehicle comprising:

a first track section and a second track section each having a first edge, a second edge, and an upper surface for supporting a toy vehicle extending between the first and second edges;

a first connector extending from the first edge of the first track section, the first connector comprising an inner surface that defines a receiving cavity;

a second connector extending from the second edge of the second track section;

wherein the first and second track sections are rotatably coupled together by positioning the second connector of the second track section within the receiving cavity of the first connector of the first track section; and wherein the first connector and the second connector have mating features that lock the first and second track sections into specific relative positions and prevent free rotation of the first track section relative to the second track section.

17. The track of claim 16 wherein the upper surfaces of the first and second track sections and the first and second connectors collectively form a track surface configured for direct engagement with a toy vehicle positioned thereon.

18. The track of claim 16 wherein the mating features comprises first features provided on the inner surface of the first connector and second features provided on an outer surface of the second connector, and wherein the first and second track sections are temporarily lockable in multiple relative positions with the upper surfaces thereof oriented at different angles relative to one another due to cooperation between the first and second features.

19. The track of claim 16 wherein the first and second track sections comprise a lower surface opposite the upper surface, and wherein the upper and lower surfaces of the first and second track sections are planar.

20. The track of claim 16 wherein one of the inner surface of the first connector of the first track section and an outer surface of the second connector of the second track section comprises ridges and the other of the inner surface of the first connector of the first track section and the outer surface of the second connector of the second track section comprises notches, and wherein the ridges of the one of the inner surface of the first connector of the first track section and the outer surface of the second connector of the second track section mate with the notches of the other of the inner surface of the first connector of the first track section and the outer surface of the second connector of the second track section to temporarily lock the first and second track sections into the specific relative positions.

* * * * *